United States Patent [19]

Skinner

[11] 3,939,603

[45] Feb. 24, 1976

[54] TRUNDLE AND WHEEL WITH SOUNDING MEANS

[75] Inventor: Emmett Skinner, Sunrise, Fla.

[73] Assignee: Lawrence Peska Associates, Inc., New York, N.Y. ; a part interest

[22] Filed: Nov. 4, 1974

[21] Appl. No.: 520,250

[52] U.S. Cl. ..... 46/114; 273/129 E; 46/220

[51] Int. Cl.[2] ..... A63B 71/00

[58] Field of Search ..... 273/126 R, 129 E; 46/220, 46/112, 114, 201, 205

[56] References Cited

UNITED STATES PATENTS

| | | | |
|---|---|---|---|
| 1,193,805 | 8/1916 | Long | 46/114 |
| 3,611,624 | 10/1971 | Nieman | 46/220 |
| 3,715,834 | 2/1973 | Gelis | 46/220 |

*Primary Examiner*—Richard C. Pinkham
*Assistant Examiner*—T. Brown
*Attorney, Agent, or Firm*—Richard E. Nanfeldt

[57] ABSTRACT

A wheel game is used by a player as a form of amusement. The wheel game includes a two sectional telescoping control stick and a wheel having a center hub and outer rim, wherein the outer rim is joined to the center hub by a plurality of flat spoke members. The control stick is applied tangentially to the outside periphery of the outer rim of the wheel causing the wheel to rotate in a vertical plane and be rolled across a horizontal plane. The center hub is made hollow to form a central chamber and having a side aperture for insertion and removal of a plurality of solid elements. The solid elements are instrumental in generating noise as a result of their striking the walls of the chamber when the wheel is rolled. The side aperture is provided with screw threads and a screw threaded cap for retaining the elements in the chamber.

2 Claims, 5 Drawing Figures

TRUNDLE AND WHEEL WITH SOUNDING MEANS

SUMMARY OF THE INVENTION

My invention relates to a unique and novel improvement in a wheel game used as a means of amusement of a player.

It is known from U.S. Patents: Nos. 2,979,860; 3,003,766; 3,242,612; and 3,464,149 that hoop rolling games have been employed, but these aforementioned patents involved: hoops, wherein vertical alignment is difficult, as well as control sticks of one given length.

Accordingly, it is an object of my present invention to provide a wheel game, wherein the construction of the wheel member allows easier vertical alignment and maintaining of such vertical alignment during the rolling of the wheel.

A further object of my present invention is to provide a means of generating noise during the rolling operation of the wheel.

Another object of my present invention is to provide a control stick which can be expanded or contracted in length for various size players.

An advantage of my present invention is that it provides a wheel game, wherein the circular member has better vertical balance.

Briefly, my present invention comprises a wheel having a center hub and an outer circular rim, wherein said outer rim is joined to said center hub by a plurality of flat spoke members. The control stick comprises a handle section telescopically communicating with a elongated cylindrical section. A flat bar member is affixed to the free outer end of the elongated cylindrical section, wherein the flat bar member engages an outside periphery of the outer rim of the wheel.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
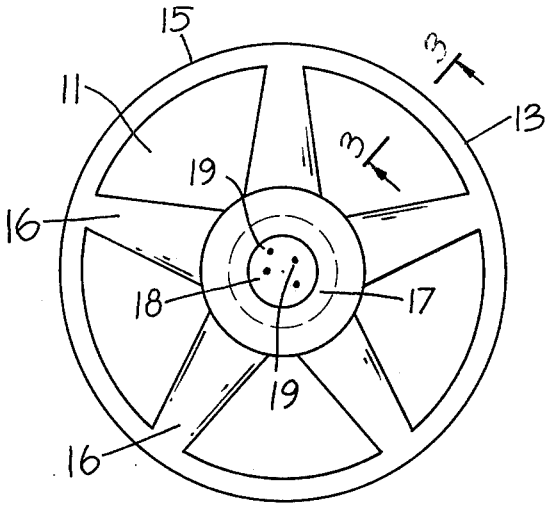
FIG. 1 illustrates a front view of the wheel of the invention.
Figure 3:
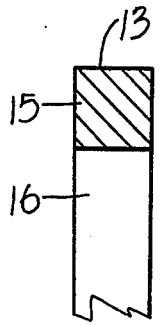
FIG. 3 illustrates a side cross sectional view of the invention.
Figure 5:
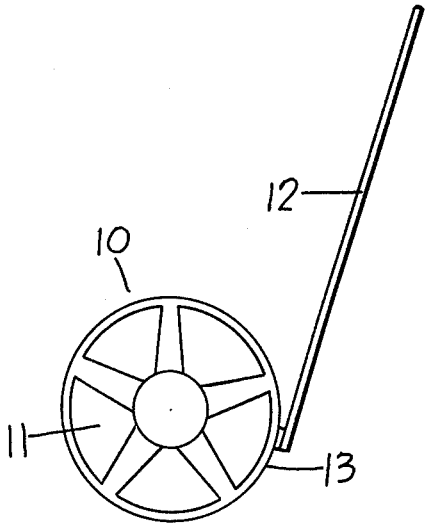
FIG. 5 illustrates a front elevated view of the invention in use.

Turning now descriptively to the drawings, in which similar reference characters denote similar elements throughout the several views, FIG. 5 shows a wheel game 10, wherein a wheel 11 is rolled along a horizontal plane by a player using a control stick 12. The player employs the control stick 12 to apply a substantially tangential force to an outside periphery 13 of the wheel 11 causing the wheel 11 to rotate in a vertical plane. As the player applies a pushing force to the control stick 12, the wheel 11 is rolled along the horizontal plane. FIGS. 1, 3 show the wheel 11, which comprises a center hub 14 joined to a circular outer rim 15 by a plurality of flat spoke members 16. The diameter of the wheel 11 is substantially at least ten to twelve inches. The outside periphery 13 of the outer rim 15 is substantially at least one half inch wide. The center hub 14 of the wheel 11 as well as the width of the outside periphery 13 of the outer rim 15 of the wheel 11 provide a positive means of maintaining a substantially vertical alignment of the rotating wheel 11 which has been a major difficulty of the hoops of the aforementioned patents. The center hub 14 of the wheel contains a hollow interior chamber 17 with a lateral screw cap face 18. Various solid elements 19 introduced within chamber 17 produce a plurality of noises as an added means of amusement during a rolling operations of the wheel 11.

Figure 2:
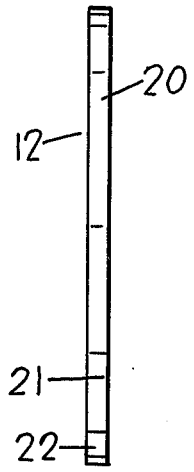
FIG. 2 illustrates a side view of the control stick of the invention.
Figure 4:
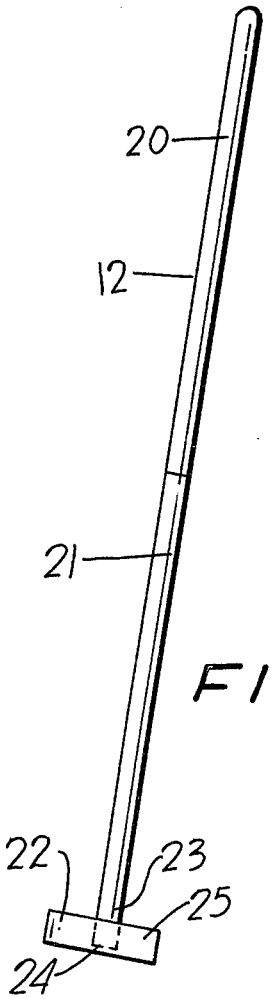
FIG. 4 illustrates a front elevated view of the control stick of the invention.

FIGS. 2–4 show a control stick 12 used to apply the tangential force to the outside periphery 13 of the wheel 11. The control stick 12 comprises an elongated cylinder shaped handle section 20 telescopically communicating with an elongated cylindrical section 21, wherein the total length of the control stick 12 is at least twenty four inches long. A flat bar member 22 is joined onto the outside longitudinal periphery 23 at a free end 24 of section 21, wherein member 22 and section 21 are described as a T shaped configuration. The flat outside surface 25 of member 22 engages the outside periphery 13 of the outer rim 15 of the wheel 11.

Hence obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A noise generating wheel game, which comprises:

a. a wheel having a center hub, an outer circular rim, and a plurality of spoke members joining said center hub to said outer circular rim, said center hub having a hollow interior chamber therein;

b. a lateral screw cap face affixed to said center hub for closing said hollow interior chamber;

c. a control stick for engaging tangentially said rim to roll said wheel on the ground; and d. a plurality of solid elements removably contained in said hollow interior chamber, said solid elements striking the walls of said interior chamber within said center hub to generate said noise as said wheel rolls on said ground.

2. A wheel game according to claim 1, wherein said control stick comprises:

a. a handle section;

b. an elongated cylinder section which telescopically engages, said handle section; and c. a flat bar member affixed to a free end of said elongated cylinder section for engaging said rim of said wheel.

* * * * *